US009437948B2

(12) United States Patent
Ju

(10) Patent No.: US 9,437,948 B2
(45) Date of Patent: Sep. 6, 2016

(54) ELECTRICAL CONNECTOR

(71) Applicant: LOTES CO., LTD, Keelung (TW)

(72) Inventor: Ted Ju, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 14/821,123

(22) Filed: Aug. 7, 2015

(65) Prior Publication Data

US 2016/0134037 A1 May 12, 2016

(30) Foreign Application Priority Data

Nov. 11, 2014 (CN) ..... 2014 2 0670094 U

(51) Int. Cl.
*H01R 12/70* (2011.01)
*H01R 13/24* (2006.01)
*H01R 12/71* (2011.01)

(52) U.S. Cl.
CPC ..... *H01R 12/7076* (2013.01); *H01R 13/2407* (2013.01); *H01R 12/714* (2013.01)

(58) Field of Classification Search
USPC ..... 439/660, 66, 71, 83, 78
See application file for complete search history.

(56) References Cited

U.S. PATENT DOCUMENTS

RE34,084 E * 9/1992 Noschese ..... H01R 12/714 439/245
6,257,899 B1 * 7/2001 Walkup ..... H01R 9/096 439/515
6,786,738 B2 * 9/2004 Lin ..... H01R 13/2435 439/71
6,955,572 B1 * 10/2005 Howell ..... H01R 13/2442 439/862
6,994,565 B2 * 2/2006 Harper, Jr. ..... H01R 12/52 439/66
7,014,477 B2 * 3/2006 Tsai ..... H05K 7/1069 439/331
8,147,256 B2 * 4/2012 Jin ..... H01R 12/52 439/83
8,708,716 B1 * 4/2014 Ho ..... H01R 12/57 439/83
8,974,236 B2 * 3/2015 Terhune, IV ..... H01R 12/714 439/733.1
2009/0253287 A1 * 10/2009 Polnyi ..... H01R 13/2457 439/331
2009/0269950 A1 * 10/2009 Liao ..... H01R 13/2435 439/66

* cited by examiner

*Primary Examiner* — Alexander Gilman
(74) *Attorney, Agent, or Firm* — Locke Lord LLP; Tim Tingkang Xia, Esq.

(57) ABSTRACT

An electrical connector includes a body having multiple receiving slots, and multiple terminals disposed in the receiving slots. Each terminal includes a base, a material connection portion extending vertically from a side of the base, a fixing portion extending vertically from another side of the base and fixable to the receiving slot, a first elastic arm bending upward and extending from the base, a first contact portion disposed at the top of the first elastic arm for contacting a chip module, at least one first bending portion formed by the first elastic arm, a second elastic arm bending downward and extending from the base, a second contact portion disposed at the bottom of the second elastic arm for contacting a circuit board, and multiple second bending portions formed by the second elastic arm. The number of the second bending portions is greater than that of the first bending portion.

20 Claims, 7 Drawing Sheets

ELECTRICAL CONNECTOR

CROSS-REFERENCE TO RELATED APPLICATION

This non-provisional application claims priority under 35 U.S.C. §119(a) on Patent Application No. 201420670094.9 filed in P.R. China on Nov. 11, 2014, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and particularly to an electrical connector for electrically connecting a chip module to a circuit board.

BACKGROUND OF THE INVENTION

An existing electrical connector is disclosed in Chinese patent No. CN201220044809.0. The electrical connector 100 is used for mating a first mating element 3 and a second mating element 4, and includes an insulating body 1. Multiple accommodating holes 13 are disposed through the insulating body 1 from the top down. Multiple terminals 2 are respectively disposed in the accommodating holes 13. The terminal 2 has a main body 20. A first bending portion 21 and a second bending portion 22 extend respectively from the main body 20 in a vertical direction. A first elastic arm 23 and a second elastic arm 24 extend respectively from the first bending portion 21 and the second bending portion 22 toward the same direction. A first contact portion 231 bends from an end of the first elastic arm 23, a second contact portion 241 bends from an end of the second elastic arm 24, and a projection of the first elastic arm 23 in a horizontal direction is shorter than a projection of the second elastic arm 24 in the horizontal direction, so when the first contact portion 231 is pressed by the first mating element 3, a forward force to which the first contact portion 231 is subject is transmitted to the second contact portion 241, and then a large forward force against the second mating element 4 is generated.

However, a currently required electrical connector is used for testing the chip module, and the second contact portion presses against the circuit board in a long term, so as to test the chip module when the chip module presses against the first contact portion multiple times. However, in the related art described above, the projection of the second elastic arm in the horizontal direction is longer than the projection of the first elastic arm in the horizontal direction, so when the chip module presses against the terminal, the lateral displacement amount of the second contact portion is greater than the lateral displacement amount of the first contact portion, the second contact portion slides on the circuit board, and after the chip module presses against the terminal multiple times, the circuit board is damaged due to pressing and friction of the second contact portion. Therefore, the foregoing terminal structure is inapplicable to the testing-type electrical connector.

Therefore, a heretofore unaddressed need exists in the art to address the aforementioned deficiencies and inadequacies.

SUMMARY OF THE INVENTION

In one aspect, the present invention is directed to an electrical connector with a large forward force for urging against a chip module, and a small forward force for urging against a circuit board.

In one embodiment, an electrical connector is used for electrically connecting with a chip module and a circuit board. The electrical connector includes a body. The body is provided with multiple receiving slots. Multiple terminals are respectively disposed in the receiving slots. The terminal has a base, a material connection portion extends vertically from a side of the base, and a fixing portion extends vertically from another side of the base. The fixing portion can be fixed to the receiving slot. The fixing portion and the material connection portion are located at two opposite sides of the base in a vertical direction. A first elastic arm bends upward and extends from the base. A first contact portion contacting the chip module is disposed at a top end of the first elastic arm. The first elastic arm forms at least one first bending portion. A second elastic arm bends downward and extends from the base. A second contact portion contacting the circuit board is disposed at a bottom end of the second elastic arm. The second elastic arm forms multiple second bending portions, and the number of the second bending portions is greater than the number of the at least one first bending portion.

In one embodiment, the base extends along a longitudinal direction, and he first elastic arm and the second elastic arm extend along a transverse direction perpendicular to the longitudinal direction. When the chip module urges against the terminal, a transverse displacement amount of the first contact portion is greater than a transverse displacement amount of the second contact portion.

In one embodiment, the first contact portion extends out of a projection area of the receiving slot, and the second contact portion is located in the projection area of the receiving slot.

In one embodiment, the number of the first bending portions is two, and angles of the two first bending portions are different.

In one embodiment, the first elastic arm includes a first transverse arm. The first transverse arm bends perpendicularly and extends from an upper edge of the base. At least one second transverse arm bends reversely from an end of the first transverse arm. The second transverse arm and the first transverse arm are parallel. The first bending portion is formed between the second transverse arm and the first transverse arm. A first slant arm further bends reversely from an end of the second transverse arm. The first bending portion is also formed between the first slant arm and the second transverse arm. The first contact portion is disposed at an end of the first slant arm.

In one embodiment, an acute angle exists between the first slant arm and the second transverse arm.

In one embodiment, the multiple second bending portions are symmetrically disposed relative to a plane on which the base is located.

In one embodiment, the second elastic arm includes a third transverse arm bending perpendicularly and extending from a lower edge of the base, multiple fourth transverse arms bend reversely from an end of the third transverse arm, the second bending portion is formed between the fourth transverse arm and the third transverse arm, the fourth transverse arm and the third transverse arm are parallel, a second slant arm bends reversely from an end of the fourth transverse arm, the second bending portion is formed between the second slant arm and the fourth transverse arm, and the second contact portion is located at an end of the second slant arm.

In one embodiment, the multiple fourth transverse arms are parallel to each other, two adjacent the fourth transverse arms extend in opposite directions, and the second bending portion is formed between two adjacent the fourth transverse arms.

In one embodiment, the number of the first bending portions is two, and the number of the second bending portions is four.

In one embodiment, the total length of the second elastic arms is greater than the total length of the first elastic arms.

In one embodiment, the first contact portion exceeds a plane on which the base is located, and the second contact portion is located within the plane on which the base is located.

In one embodiment, two material connection portions are disposed. The two material connection portions respectively extend upward vertically from two opposite sides of the base, and are symmetrically disposed.

In one embodiment, two fixing portions are disposed. The two fixing portions respectively extend downward vertically from two opposite sides of the base, and are symmetrically disposed.

In one embodiment, a barb is disposed at an end of the fixing portion, a stopping portion is disposed at a side of the material connection portion close to the fixing portion, a protruding block is disposed at a side of the receiving slot, and the protruding block is located between the barb and the stopping portion.

In one embodiment, the distance between the barb and the stopping portion is greater than the length of the protruding block, and the terminal can float in the receiving slot.

In one embodiment, the receiving slot has a fixing slot used for receiving the fixing portion, and an accommodating slot used for accommodating the first elastic arm and the second elastic arm extends transversely from the fixing slot to each of two sides.

In one embodiment, the electrical connector further includes a cover disposed above the body. The cover is provided with multiple through-holes for the first contact portions to enter therein and extend out of the top of the cover. A reserved slot used for accommodating the first elastic arm is disposed at a side of the through-hole.

In one embodiment, when the chip module presses against the terminal, the first contact portion is transversely displaced in the through-hole, and the length of the through-hole in a transverse direction is greater than a transverse displacement amount of the first contact portion.

In one embodiment, a protruding portion protrudes from a position nearby each of the through-holes toward the body. When the chip module presses against the terminal, the cover moves toward the body, and finally the protruding portion urges against the body.

Compared with the related art, the present invention has the following beneficial advantages.

The first elastic arm bends upward and extends from the base, the first contact portion contacting the chip module is disposed at the top end of the first elastic arm, the first elastic arm forms at least one first bending portion, the second elastic arm bends downward and extends from the base, the second contact portion contacting the circuit board is disposed at the bottom end of the second elastic arm, the second elastic arm forms multiple second bending portions, and the number of the second bending portions is greater than the number of the first bending portions. Before the chip module presses against the terminal, the second contact portion has pressed against the circuit board. Because the number of the second bending portions is greater, the force arm of the second elastic arm is longer, and the strength with which the second contact portion presses against the circuit board is smaller, the circuit board is not easily crushed. When the chip module presses downward against the terminal, the forward force to which the first contact portion is subject is transmitted to the second contact portion, so as to increase the forward force between the second contact portion and the circuit board, and ensure stable electrical contact during working.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
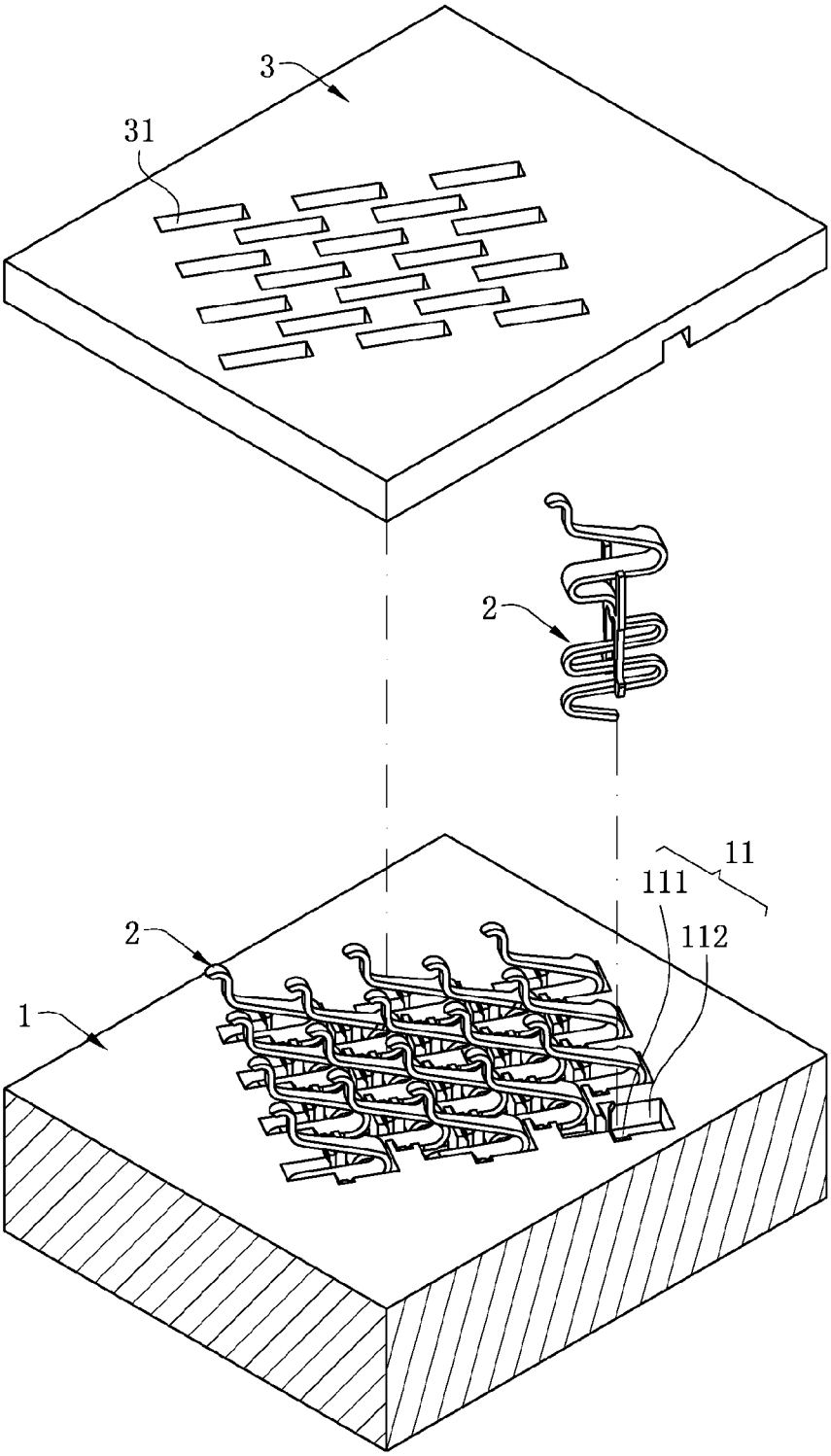
FIG. 1 is a three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-7. In accordance with the purposes of this invention, as embodied and broadly described herein, this invention, in one aspect, relates to an electrical connector.

Figure 5:
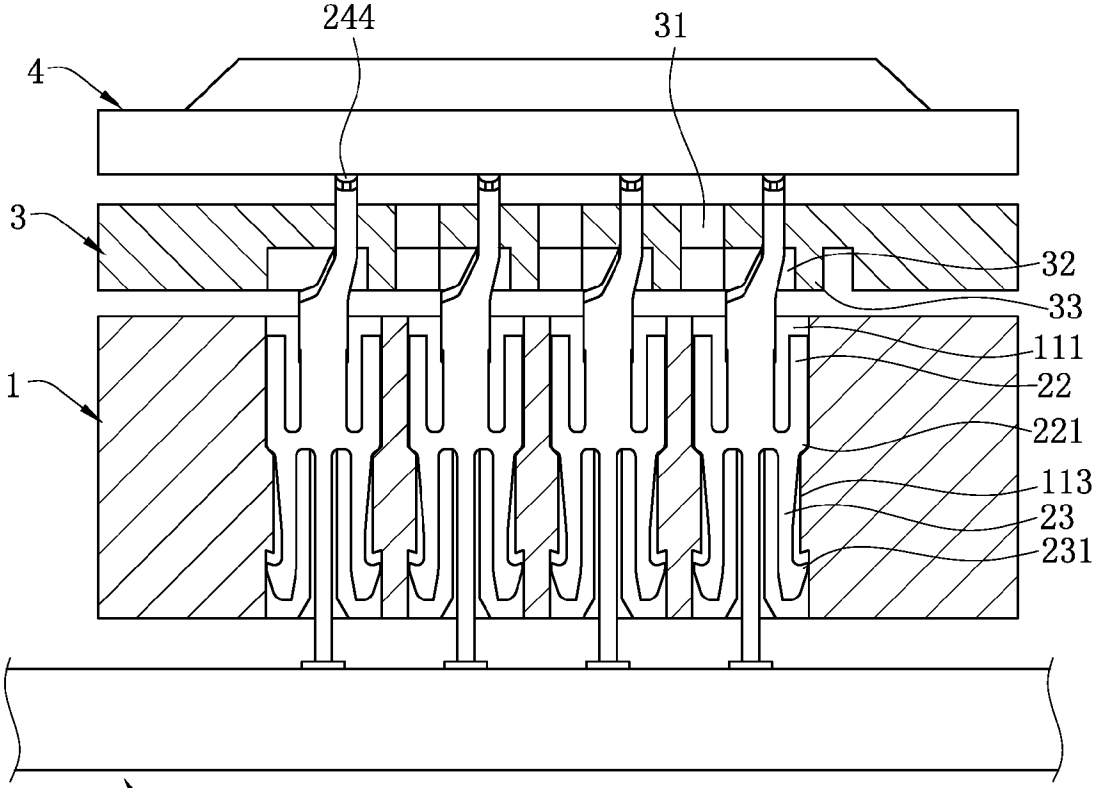
FIG. 5 is a sectional view obtained from another view angle at the time when the chip module presses against the terminal in the electrical connector according to one embodiment of the present invention.

As shown in FIG. 1 and FIG. 5, an electrical connector of the present invention is used for electrically connecting a chip module 4 and a circuit board 5. The electrical connector includes a body 1, multiple terminals 2 disposed in the body 1, and a cover 3 disposed above the body 1.

Figure 2:
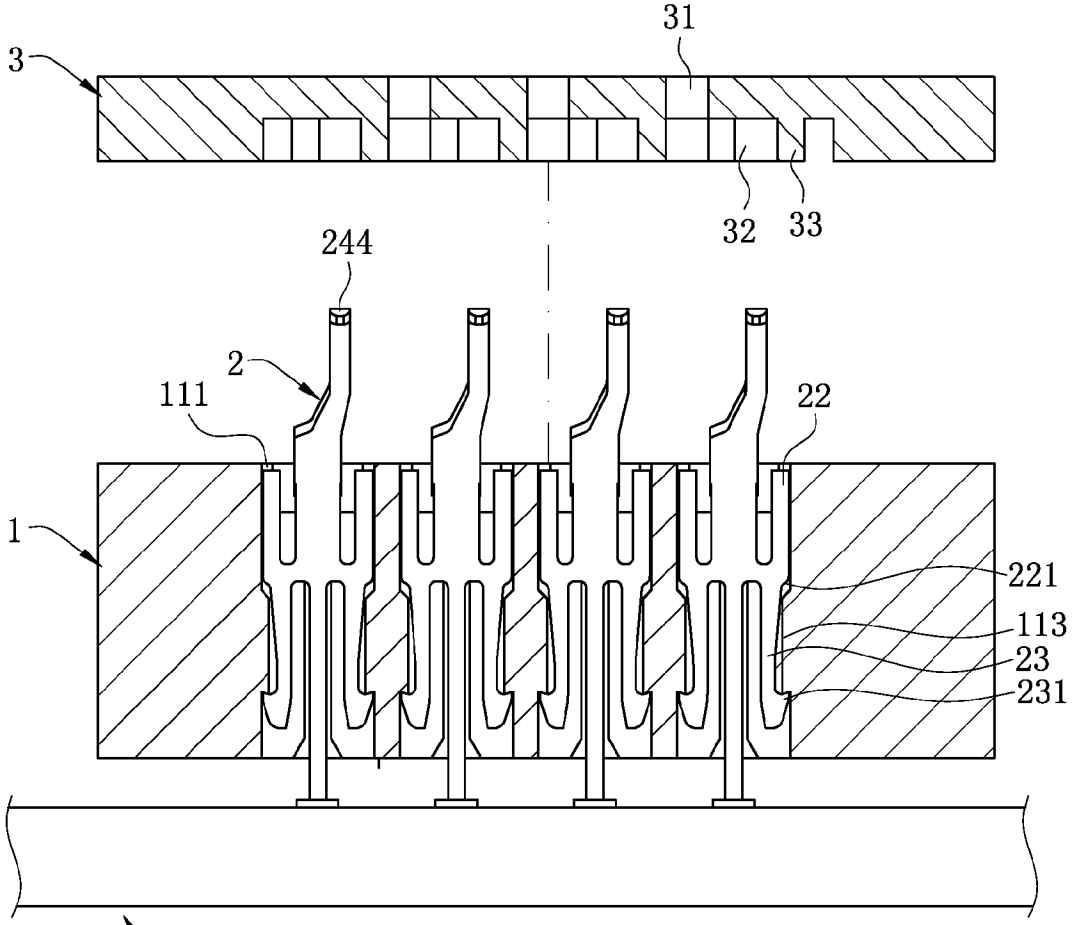
FIG. 2 is a sectional view of the electrical connector according to one embodiment of the present invention.

As shown in FIG. 1 and FIG. 2, multiple receiving slots 11 are disposed through the body 1 from the top down. The receiving slots 11 are arranged in rows along a transverse direction and a longitudinal direction perpendicular to the transverse direction. When viewed from top or bottom, each of the receiving slots 11 is cross shaped, where a fixing slot 111 disposed in the middle of the receiving slot 11 extends along the longitudinal direction, and an accommodating slot 112 extends transversely from the middle of the fixing slot 111 to each of two sides. The width of the fixing slot 111 and the thickness of the terminal 2 are approximately equivalent, and two protruding blocks 113 protrude from two side walls of the fixing slot 111.

As shown in FIGS. 1-3 and 7, the multiple terminals 2 are respectively disposed in the receiving slots 11. Each of the terminals 2 has a base 21 extending along the longitudinal direction and located in the fixing slot 111. At least one material connection portion 22 extends vertically upward from an upper edge of the base 21, and at least one fixing portion 23 extends vertically downward from a lower edge of the base 21. In other embodiments, the material connection portion 22 may extend downward from the base 21, and the fixing portion 23 may extend upward from the base 21. In this embodiment, two material connection portions 22 are disposed, and respectively extends upward vertically from two opposite sides of the base 21 along the longitudinal direction, and the two material connection portions 22 are symmetrically disposed. Two fixing portions 23 are also disposed, and respectively extend downward vertically from two opposite sides of the base 21 along the longitudinal direction, and the two fixing portions 23 are symmetrically disposed. The fixing portions 23 and the material connection portions 22 are located at two opposite sides of the base 21 in the up-down direction. In other embodiments, only one fixing portion 23 and one material connection portion 22 may be disposed, and are respectively located at upper and lower sides of the base 21. Both the material connection portion 22 and the fixing portion 23 are located in the fixing slot 111, and the thickness direction thereof is limited by the side wall of the fixing slot 111. A barb 231 is disposed at an end of the fixing portion 23, a stopping portion 221 is disposed at a side of the material connection portion 22 close to the fixing portion 23. When the terminal 2 is mounted to the receiving slot 11, the protruding block 113 is located between the barb 231 and the stopping portion 221, and the distance between the barb 231 and the stopping portion 221 is greater than the length of the protruding block 113, so that the terminal 2 can float up and down. The barb 231 and the stopping portion 221 optionally urge against the protruding block 113, and when the terminal 2 moves upward, the barb 231 moves upward until the barb 231 urges against a lower surface of the protruding block 113, which prevents the terminal 2 from continuously moving upward. When the terminal 2 moves downward, the stopping portion 221 moves downward until the stopping portion 221 urges against an upper surface of the protruding block 113, which prevents the terminal 2 from continuously moving downward, which can ensure that the terminal 2 moves up and down within a range in the receiving slot 11, and also prevents it from getting out of the receiving slot 11.

Figure 3:
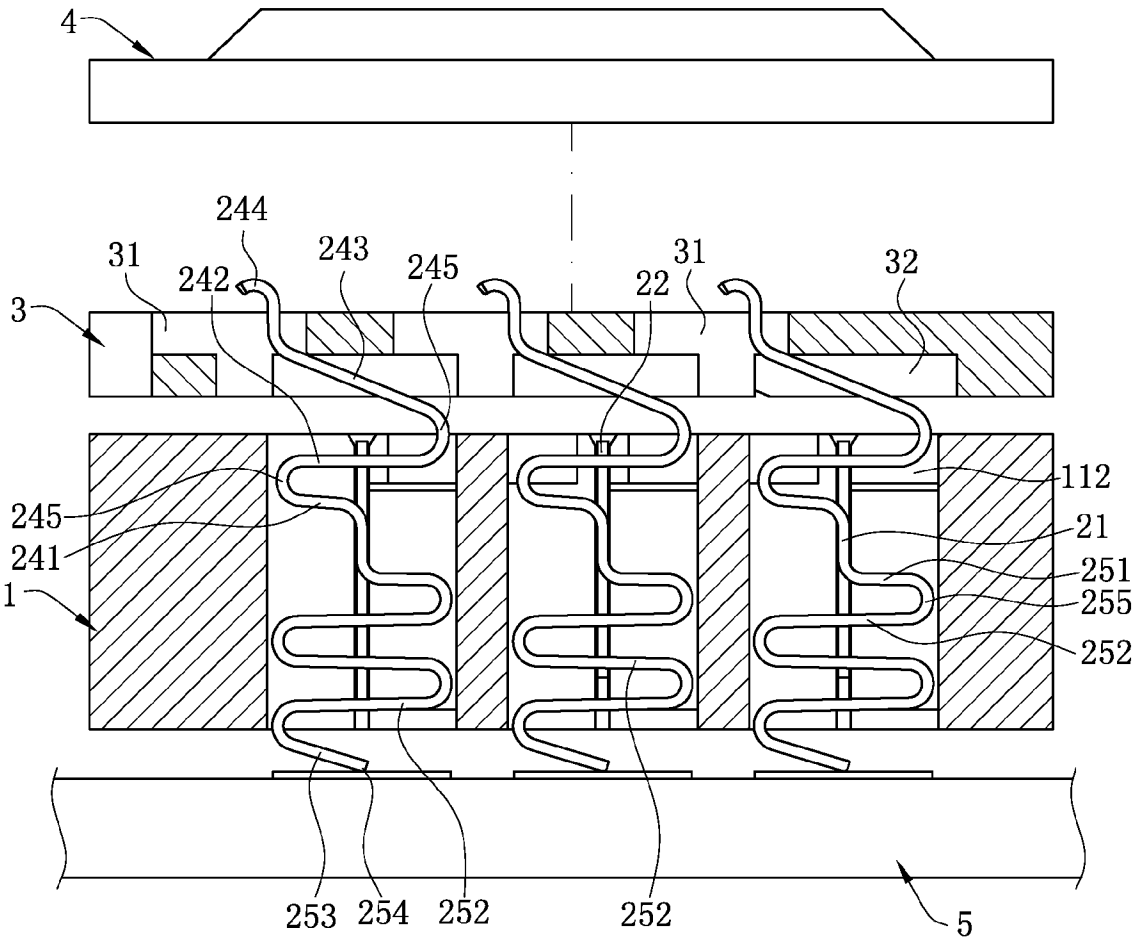
FIG. 3 is a sectional view of the electrical connector according to one embodiment of the present invention from another view angle.
Figure 7:
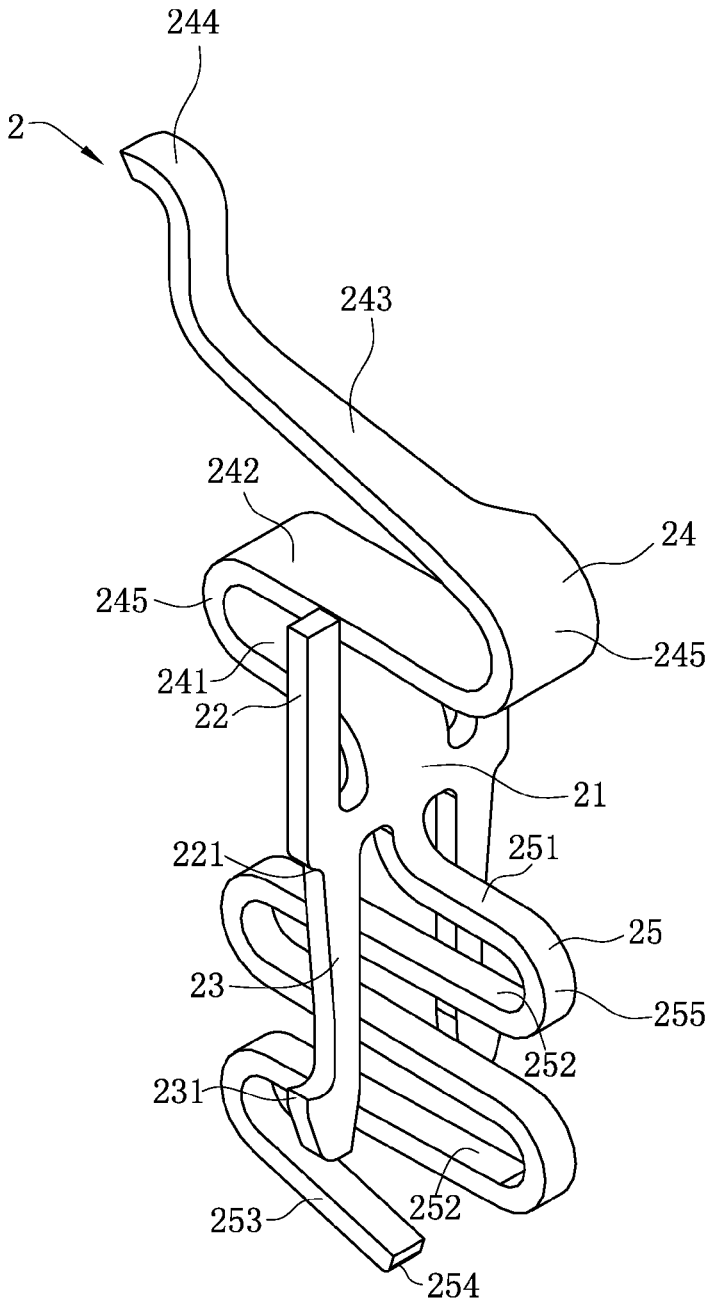
FIG. 7 is a three-dimensional view of the terminal in the electrical connector according to one embodiment of the present invention.

As shown in FIG. 3 and FIG. 7, a first elastic arm 24 bends upward and extends from the base 21 and is located in the accommodating slot 112. The first elastic arm 24 is located between the two material connection portions 22. A first contact portion 244 contacting the chip module 4 is disposed at a top end of the first elastic arm 24. The first elastic arm 24 forms at least one first bending portion 245. In this embodiment, the number of the first bending portions 245 is two. The first elastic arm 24 includes a first transverse arm 241 bending perpendicularly and extending from an upper edge of the base 21. The first transverse arm 241 extends along the transverse direction. A second transverse arm 242 bends reversely from an end of the first transverse arm 241. The second transverse arm 242 and the first transverse arm 241 are parallel. The first bending portion 245 is formed between the second transverse arm 242 and the first transverse arm 241. A first slant arm 243 further bends reversely from an end of the second transverse arm 242. The first bending portion 245 is also formed between the first slant arm 243 and the second transverse arm 242. The first contact portion 244 is disposed at an end of the first slant arm 243. An acute angle is formed between the first slant arm 243 and the second transverse arm 242, so that angles of the two first bending portions 245 are different. The first slant arm 243 extends across the first bending portion 245, so that the first contact portion 244 exceeds a plane on which the base 21 is located, and further extends out of a projection area of the receiving slot 11, so as to contact the chip module 4.

As shown in FIG. 3 and FIG. 7, a second elastic arm 25 bends downward and extends from the base 21 and is located in the accommodating slot 112. A second contact portion 254 contacting the circuit board 5 is disposed at a bottom end of the second elastic arm 25. The second elastic arm 25 is in a consecutive "S" shape, to form multiple second bending portions 255, and the multiple second bending portions 255 are symmetrically disposed relative to a plane on which the base 21 is located. In this embodiment, the number of the second bending portions 255 is four, and the number of the second bending portions 255 is greater than the number of the first bending portions 245, so that the total length of the second elastic arms 25 is greater than the total length of the first elastic arms 25. When the electrical connector is not in operation, the terminal 2 keeps pressing against the circuit board 5 in a long term. The second elastic arm 25 is long, and a forward force with which the terminal 2 presses against the circuit board 5 is small, so the circuit board 5 will not be damaged because of an excessively large strength. The second elastic arm 25 includes a third transverse arm 251 bending perpendicularly and extending from a lower edge of the base 21. The third transverse arm 251 extends along the transverse direction. Multiple fourth transverse arms 252 bend reversely from an end of the third transverse arm 251. The second bending portion 255 is formed between the fourth transverse arm 252 and the third transverse arm 251, and the fourth transverse arm 252 and the third transverse arm 251 are parallel. The multiple fourth transverse arms 252 are parallel to each other. Each of the fourth transverse arms 252 bends reversely and extends from an end of a previous transverse arm of the fourth transverse arms 252, and two adjacent the fourth transverse arms 252 extend in opposite directions. The second bending portion 255 is formed between every two adjacent the fourth transverse arms 252, and angles of all the second bending portions 255 are approximately the same. A second slant arm 253 bends reversely from an end of the fourth transverse arm 252. The second bending portion 255 is formed between the second slant arm 253 and the fourth transverse arm 252. The second contact portion 254 is located at an end of the second slant arm 253, and the second contact portion 254 is located within a plane on which the base 21 is located. That is to say, the second contact portion 254 is located within a projection area of the receiving slot 11. When the chip module 4 presses against the terminal 2, the first contact portion 244 is pressed downward and moves transversely, the second contact portion 254 is located within the plane on which the base 21 is located, and the center of a force to which the second contact portion 254 is subject is located at the position of the center line of a force to which the terminal 2 is subject, so the amount of the displacement of the second contact portion 254 in the transverse direction is very small or zero. That is to say, the transverse displacement amount of the first contact portion 244 is far greater than the transverse displacement amount of the second contact portion 254. When the first contact portion 244 contacts the chip module 4, an oxidation film on the chip module 4 may be scratched, which can increase the contact force, and can also ensure that a contact force between the second contact portion 254 and the circuit board 5 is small, and the circuit board 5 will not be scratched.

As shown in FIG. 1 and FIG. 2, the cover 3 is located above the body 1, and the cover 3 is in a plate shape. Multiple through-holes 31 are disposed through the cover 3 from the top down for the first contact portion 244 to enter therein and extend out of the top of the cover 3. The length of the through-hole 31 in the transverse direction is greater than the transverse displacement amount of the first contact portion 244. When the first contact portion 244 is pressed, the first contact portion 244 can move laterally inside the through-hole 31. A reserved slot 32 used for accommodating the first slant arm 243 is disposed at a side of each of the through-holes 31, so that the first slant arm 243 may be deformed inside the reserved slot 32. A protruding portion 33 protrudes from a position nearby each of the through-holes 31 toward the body 1. When the chip module 4 presses against the terminal 2, the cover 3 moves toward the body 1. Finally the protruding portion 33 urges against the body 1, and the cover 3 supports the chip module 4, to prevent it from excessively moving downward.

As shown in FIG. 2 and FIG. 3, the electrical connector is used for testing a function of the chip module 4. The second contact portion 254 presses against the circuit board 5 in a long term. When the chip module 4 does not urge against the terminal 2, the terminal 2 is pressed by the circuit board 5 and floats upward, and the barb 231 hooks the lower surface of the protruding block 113, to prevent the terminal 2 from excessively moving upward. In this case, a gap exists between the stopping portion 221 and the protruding block 113, and meanwhile, the cover 3 is supported upward by the first slant arm 243 so that an interval exists between the cover 3 and the top surface of the body 1. The number of the second bending portions 255 is large, and the length of the second elastic arm 25 is large, so the strength with which the second elastic arm 25 urges against the circuit board 5 is small, and the circuit board 5 will not be easily crushed due to a continuously excessively large pressure in the process that the second contact portion 254 urges against the circuit board 5 in a long term.

Figure 4:
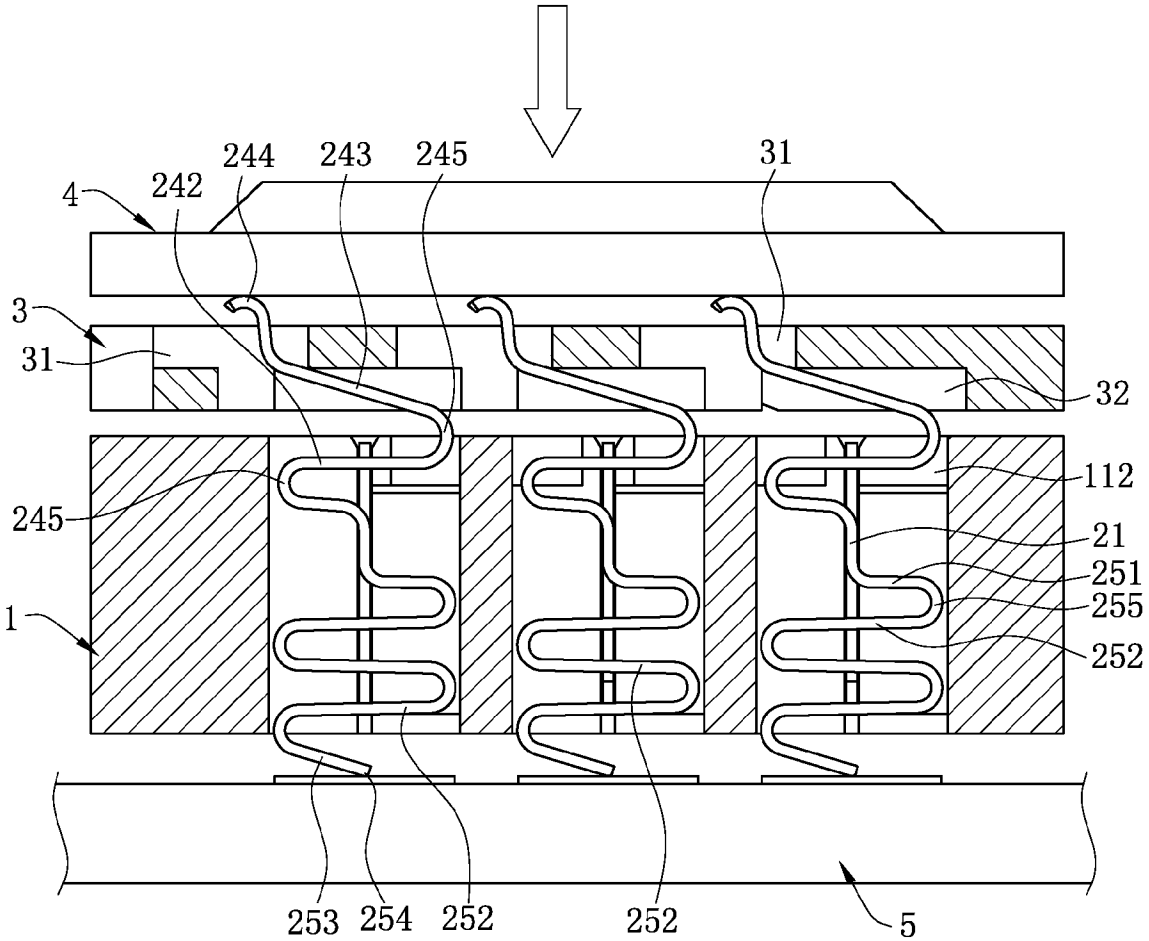
FIG. 4 is a sectional view obtained at a time when a chip module presses against a terminal in the electrical connector according to one embodiment of the present invention.
Figure 6:
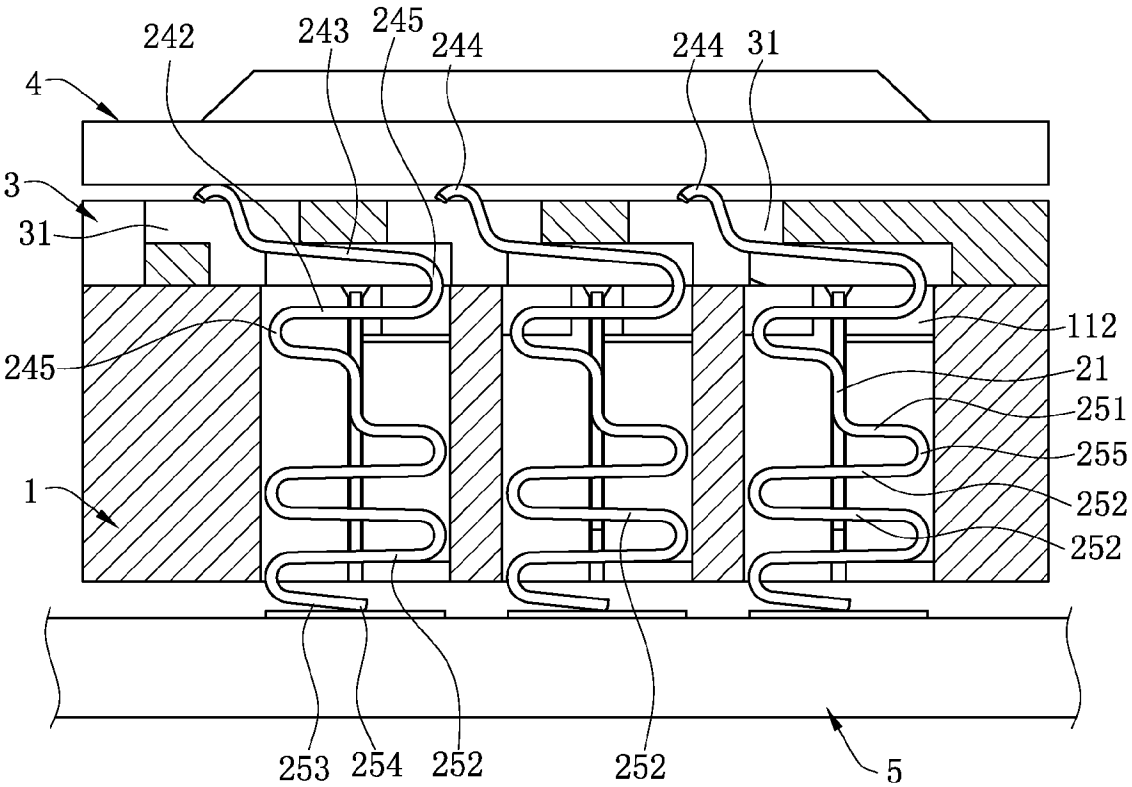
FIG. 6 is a sectional view obtained from the time when the chip module presses against the terminal to a time when the chip module stops pressing in the electrical connector according to one embodiment of the present invention.

As shown in FIGS. 4-6, when the chip module 4 presses against the first contact portion 244 from the top down, the chip module 4 applies a downward acting force to the terminal 2. The acting force makes the terminal 2 move downward. In this case, the stopping portion 221 urges against the protruding block 113. Subsequently, the chip module 4 is continuing pressed and moves downward, the first elastic arm 24 is deformed downward, and the first contact portion 244 moves in the transverse direction. Meanwhile, the cover 3 moves downward along with the first slant arm 243 until the cover 3 urges against the top surface of the body 1. The acting force to which the first elastic arm 24 is subject is transmitted to the second elastic arm 25, so that the strength with which the second contact portion 254 presses against the circuit board 5 increases, to ensure that there is a sufficient forward force for contact between the second contact portion 254 and the circuit board 5. The second contact portion 254 is located within the plane on which the base 21 is located, and the point of the force to which the second contact portion 254 is subject is located at the position of the center line of the force to which the terminal 2 is subject, so the displacement amount of the second contact portion 254 in the transverse direction is very small or zero, and therefore the circuit board 5 will not be scratched.

As shown in FIG. 3, after the test on the chip module 4 is completed, the chip module 4 is removed, and the terminal 2 floats upward. In this case, the strength with which the second contact portion 254 presses against the circuit board 5 is reduced, so the circuit board 5 will not be pressed with a large strength in a long term, so as to well protect the circuit board 5, and increase the service life.

To sum up, the electrical connector according to certain embodiment of the present invention, among other things, has the following beneficial advantages.

(1) The number of the second bending portions 255 is greater than the number of the first bending portions 245, and the length of the second elastic arm 25 is greater than the length of the first elastic arm 24, so the strength with which the second elastic arm 25 urges against the circuit board 5 is smaller. When the chip module 4 does not urge against the terminal 2, the circuit board 5 will not be crushed due to a continuously excessively large pressure in the process, where the second contact portion 254 keeps pressing against the circuit board 5 in a long term. Meanwhile, when the chip module 4 urges against the first contact portion 244, the forward force between the chip module 4 and the terminal 2 is large, and can ensure good contact between the both.

(2) The second contact portion 254 is located within the plane on which the base 21 is located, and the point of the force to which the second contact portion 254 is subject is located at the position of the center line of the force to which the terminal 2 is subject, so the displacement amount of the second contact portion 254 in the transverse direction is very small or zero, and therefore the circuit board 5 will not be scratched.

(3) The barb 231 is disposed at the end of the fixing portion 23, and the stopping portion 221 is disposed at the side of the material connection portion 22 close to the fixing portion 23. When the terminal 2 is mounted to the receiving slot 11, the protruding block 113 is located between the barb 231 and the stopping portion 221, and the distance between the barb 231 and the stopping portion 221 is greater than the length of the protruding block 113, so that the terminal 2 can float up and down. Therefore, the downward acting force of the chip module 4 is transmitted by the first contact portion 244 to the second contact portion 254, to ensure there is a sufficient forward force for contact between the second contact portion 254 and the circuit board 5.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector for electrically connecting with a chip module and a circuit board, comprising:

a body having a plurality of receiving slots; and a plurality of terminals disposed in the receiving slots respectively, wherein each of the terminals comprises:

a base;

a material connection portion extending vertically from a side of the base;

a fixing portion extending vertically from another side of the base and fixable to the receiving slot, wherein the fixing portion and the material connection portion are located at two opposite sides of the base in a vertical direction;

a first elastic arm bending upward and extending from the base;

a first contact portion disposed at a top end of the first elastic arm for contacting the chip module;

at least one first bending portion formed by the first elastic arm;

a second elastic arm bending downward and extending from the base;

a second contact portion disposed at a bottom end of the second elastic arm for contacting the circuit board; and a plurality of second bending portions formed by the second elastic arm, wherein the number of the second bending portions is greater than the number of the at least one first bending portion; and wherein the total length of the second elastic arm is greater than the total length of the first elastic arm.

2. The electrical connector according to claim 1, wherein the base extends along a longitudinal direction, the first elastic arm and the second elastic arm extend along a transverse direction perpendicular to the longitudinal direction, and when the chip module urges against the terminal, a transverse displacement amount of the first contact portion is greater than a transverse displacement amount of the second contact portion.

3. The electrical connector according to claim 1, wherein the first contact portion extends out of a projection area of the receiving slot, and the second contact portion is located in the projection area of the receiving slot.

4. The electrical connector according to claim 1, wherein the number of the first bending portions is two, and angles of the two first bending portions are different.

5. The electrical connector according to claim 1, wherein the first elastic arm comprises a first transverse arm bending perpendicularly and extending from an upper edge of the base, at least one second transverse arm bends reversely from an end of the first transverse arm, the second transverse arm and the first transverse arm are parallel, the first bending portion is formed between the second transverse arm and the first transverse arm, a first slant arm further bends reversely from an end of the second transverse arm, the first bending portion is also formed between the first slant arm and the second transverse arm, and the first contact portion is disposed at an end of the first slant arm.

6. The electrical connector according to claim 5, wherein an acute angle exists between the first slant arm and the second transverse arm.

7. The electrical connector according to claim 1, wherein the second bending portions are symmetrically disposed relative to a plane on which the base is located.

8. The electrical connector according to claim 1, wherein the second elastic arm comprises a third transverse arm bending perpendicularly and extending from a lower edge of the base, a plurality of fourth transverse arms bend reversely from an end of the third transverse arm, the second bending portion is formed between the fourth transverse arm and the third transverse arm, the fourth transverse arm and the third transverse arm are parallel, a second slant arm bends reversely from an end of the fourth transverse arm, the second bending portion is formed between the second slant arm and the fourth transverse arm, and the second contact portion is located at an end of the second slant arm.

9. The electrical connector according to claim 8, wherein the fourth transverse arms are parallel to each other, two adjacent the fourth transverse arms extend in opposite directions, and the second bending portion is formed between two adjacent the fourth transverse arms.

10. The electrical connector according to claim 1, wherein the number of the first bending portions is two, and the number of the second bending portions is four.

11. The electrical connector according to claim 1, wherein the first contact portion exceeds a plane on which the base is located, and the second contact portion is located within the plane on which the base is located.

12. The electrical connector according to claim 1, wherein two material connection portions are disposed symmetrically, the two material connection portions extend respectively upward vertically from two opposite sides of the base.

13. The electrical connector according to claim 1, wherein two fixing portions are disposed symmetrically, the two fixing portions extend respectively downward vertically from two opposite sides of the base.

14. The electrical connector according to claim 1, wherein a barb is disposed at an end of the fixing portion, a stopping portion is disposed at a side of the material connection portion close to the fixing portion, a protruding block is disposed at a side of the receiving slot, and the protruding block is located between the barb and the stopping portion.

15. The electrical connector according to claim 14, wherein the distance between the barb and the stopping portion is greater than the length of the protruding block, and the terminal is floatable in the receiving slot.

16. The electrical connector according to claim 1, wherein the receiving slot comprises a fixing slot and an accommodating slot extending transversely from each of two sides of the fixing slot, the fixing slot is used for accommodating the fixing portion and the accommodating slot is used for accommodating the first elastic arm and the second elastic arm.

17. The electrical connector according to claim 1, further comprising a cover disposed above the body, wherein the cover has a plurality of through-holes for the first contact portions to enter therein and extend out of the top of the cover, and a reserved slot is disposed at a side of the through-hole for accommodating the first elastic arm.

18. The electrical connector according to claim 17, wherein when the chip module presses against the terminal, the first contact portion is transversely displaced in the through-hole, and the length of the through-hole in a transverse direction is greater than a transverse displacement amount of the first contact portion.

19. The electrical connector according to claim 17, further comprising a protruding portion protruding from a position nearby each of the through-holes toward the body, wherein when the chip module presses against the terminal, the cover moves toward the body, and the protruding portion urges against the body.

20. An electrical connector for electrically connecting with a chip module and a circuit board, comprising:

a body having a plurality of receiving slots; and a plurality of terminals disposed in the receiving slots respectively, wherein each of the terminals comprises:

a base;

a material connection portion extending vertically from a side of the base;

a fixing portion extending vertically from another side of the base and fixable to the receiving slot, wherein the fixing portion and the material connection portion are located at two opposite sides of the base in a vertical direction;

a first elastic arm bending upward and extending from the base;

a first contact portion disposed at a top end of the first elastic arm for contacting the chip module;

at least one first bending portion formed by the first elastic arm;

a second elastic arm bending downward and extending from the base;

a second contact portion disposed at a bottom end of the second elastic arm for contacting the circuit board; and a plurality of second bending portions formed by the second elastic arm, wherein the number of the second bending portions is greater than the number of the at least one first bending portion; and wherein the first contact portion exceeds a plane on which the base is located, and the second contact portion is located within the plane on which the base is located.

* * * * *